US010822191B2

(12) United States Patent
Johnson et al.

(10) Patent No.: US 10,822,191 B2
(45) Date of Patent: Nov. 3, 2020

(54) MEDIA REGISTRATION SYSTEM WITH MEDIA SENSING

(71) Applicant: HEWLETT-PACKARD DEVELOPMENT COMPANY, L.P., Houston, TX (US)

(72) Inventors: Bruce G. Johnson, Vancouver, WA (US); Ellioitt Downing, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 13 days.

(21) Appl. No.: 16/176,764

(22) Filed: Oct. 31, 2018

(65) Prior Publication Data

US 2020/0137246 A1 Apr. 30, 2020

(51) Int. Cl.
*B65H 29/04* (2006.01)
*B65H 29/18* (2006.01)
*B65H 29/12* (2006.01)

(52) U.S. Cl.
CPC ..... *B65H 29/04* (2013.01); *B65H 29/12* (2013.01); *B65H 29/18* (2013.01)

(58) Field of Classification Search
CPC ..... B65H 29/04; B65H 29/12; B65H 29/18; B65H 29/28; B65H 29/36; B65H 31/34; B65H 29/041; B65H 29/125; B65H 29/14; B65H 2301/3613; B65H 2301/421; B65H 2511/20; B65H 2511/23; B65H 2511/232
USPC ..... 271/176, 200, 204, 314, 207
See application file for complete search history.

(56) References Cited

U.S. PATENT DOCUMENTS

| | | | | |
|---|---|---|---|---|
| 4,878,656 | A | 11/1989 | Honjo et al. | |
| 5,083,760 | A | 1/1992 | Yamazaki et al. | |
| 7,147,217 | B2 | 12/2006 | Jung et al. | |
| 7,627,282 | B2 | 12/2009 | Oka et al. | |
| 7,845,634 | B2 * | 12/2010 | Asakawa | B65H 29/22 271/200 |
| 9,323,205 | B2 | 4/2016 | Mine et al. | |
| 9,409,740 | B2 | 8/2016 | Kubo et al. | |

FOREIGN PATENT DOCUMENTS

JP 2009263026 11/2009

* cited by examiner

*Primary Examiner* — David H Bollinger
(74) *Attorney, Agent, or Firm* — Dicke Billig & Czaja PLLC

(57) ABSTRACT

A media registration system including an accumulation region and a transport track to receive and transport each media sheet of a series of media sheets forming a media job in a transport direction from an intake end to a registration end proximate to the accumulation region, and to stack the media sheets of the media job in the accumulation region to form a job stack. A translator adjusts a position of the registration end of the transport track in a direction lateral to the transport direction for each sheet to align edges of each sheet of the job stack in the lateral direction. A media sensor indicates a position of each sheet along the media path to facilitate a controller to determine an accumulation status of the job stack.

17 Claims, 8 Drawing Sheets

MEDIA REGISTRATION SYSTEM WITH MEDIA SENSING

BACKGROUND

Post-imaging operations for sheets of imaging media output from an image forming apparatus, such as a printer, for instance, include accumulating and aligning sheets to form a stack for performance of secondary operations, such as stapling and hole-punching, for example.

DETAILED DESCRIPTION

Figure 1:
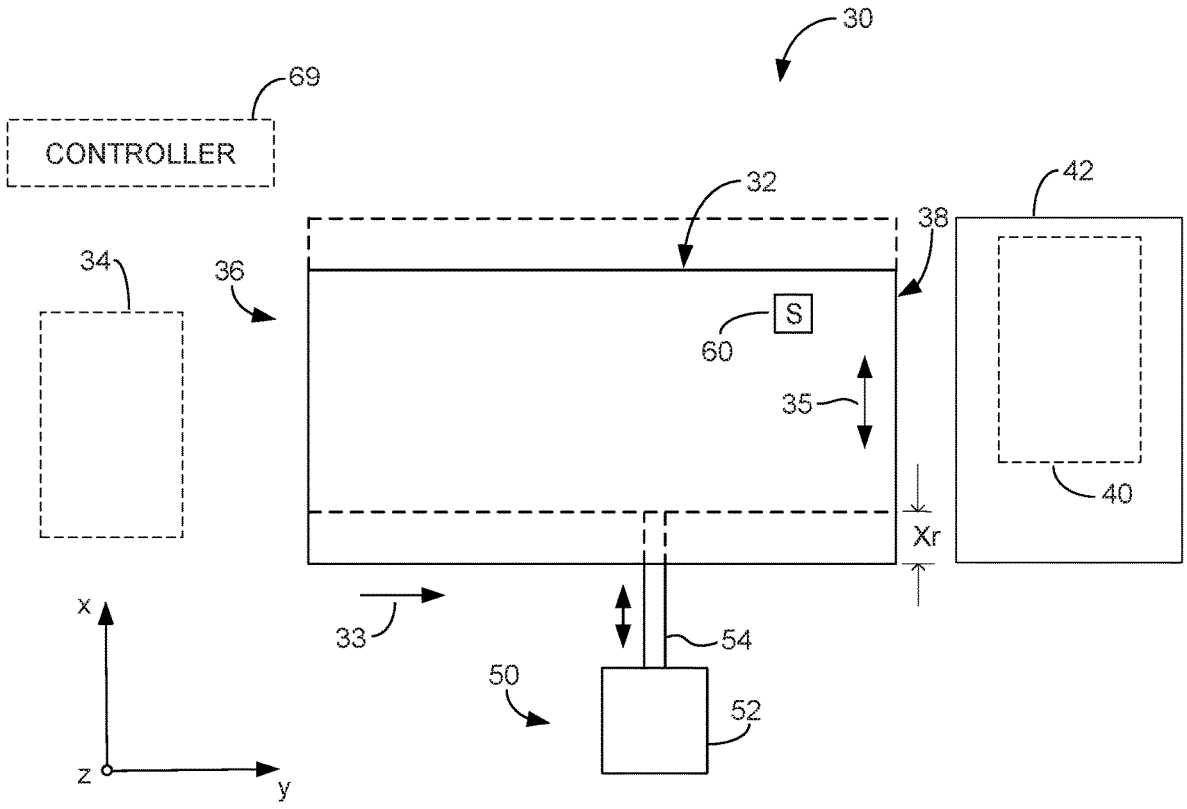
FIG. 1 is a block and schematic diagram generally illustrating a top view of a media registration system, according to one example.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Upon receiving sheets of media output from and image forming apparatus, such as a printer, for example, media output systems may accumulate and align the media sheets of a given imaging "job" to form a job stack on which secondary operations may be performed, such as stapling and hole-punching, for instance. Aligning and stacking sheets of media is sometimes referred to as "registration", with media output system sometimes being referred to as media registration systems.

To register media sheets of a given job, some media registration systems use mechanical mechanisms to tap the sides of the media sheets to position the sheets in a first direction (e.g., an x-direction), and convey the sheets against a registration surface, such as a registration wall, to align the sides of the sheets in a second direction (e.g., a y-direction). However, such techniques fail to account for media feed errors that may occur as the media registration systems transport the media sheets to an accumulation region for stacking, and fail to account for properties that may vary between sheets of a given type (e.g., sheet stiffness can vary based on an image formed thereon), both of which can cause errors in the positioning of the sheets (e.g., misalignment between sheets of a job stack). A large number of sheets in a given job may also adversely affect alignment of a job stack. As a result, such media registration systems may undesirably forward misaligned or otherwise improperly accumulated job stacks for stapling, hole-punching, or other secondary operations.

According to examples of the present disclosure, as will be described in greater detail herein, a media registration system includes a media sensor to indicate a position of each media sheet of a series of media sheets forming a media job as the media sheets are transported to and stacked in an accumulation region to form a job stack. In examples, more than one media sensor may be employed. The indicated position of each media sheet facilitates a controller to determine an accumulation status of the job stack (e.g., whether the job stack is properly aligned). In one example, if a media sheet is not at an acceptable location, registration of a partially completed media job may be halted and user intervention requested. In another example, accumulation of a job stack may be completed with misaligned sheets, but not be forwarded for secondary operations.

FIG. 1 is a block and schematic diagram generally illustrating a top view of a media registration system 30, according to one example of the present disclosure. Media registration system 30 includes a transport track 32 to transport each media sheet 34 of a series of media sheets forming a media job (from an image forming apparatus, such as a printer, for example) in a transport direction 33 (illustrated as a y-direction in FIG. 1) from an intake end 36 to a registration end 38, and to stack the media sheets 34 to form a job stack 40 in an accumulation region 42 at a registration end 38. In one example, accumulation region 42 may be disposed vertically below registration end 38.

In one example, media registration system 30 includes a translator 50 to adjust a position of registration end 38 in a direction 35 lateral to transport direction 33. In one example, lateral direction 35 is orthogonal to transport direction 33 (such as an x-direction in FIG. 1). In examples, translator 50 adjusts the position of registration end 38 for each media sheet 34 of a media job so as to align edges of each media sheet 34 of job stack 40 in lateral direction 35 as the media sheets 34 are stacked in accumulation region 42.

In one example, translator 50 includes a driver 52 and a translation element 54 operatively coupled to transport track 32, where driver 52 drives translation element 54 to adjust the position of registration end 38 of transport track 32 in lateral direction 35. In one example, as illustrated in FIG. 1, translator 50 adjusts a position of registration end 38 in lateral direction 35 (e.g., x-direction) by a registration distance Xr by translating transport track 32 in lateral direction 35 from a home position (illustrated by solid lines) to a translated position (illustrated by dashed lines). In other examples, as described below, translator 50 may rotate transport track 32 to adjust the position of registration end 38 in lateral direction 35 by registration distance Xr.

According to one example, media registration system 30 includes a media sensor 60 disposed along transport track 32 to indicate a position of media sheet 34 as it is transported along transport track 32, where the indicated position (or lack thereof) facilitates a controller, such as controller 69, to determine an accumulation status of job stack 40, where the accumulation status may be whether edges of media sheets 34 of job stack 40 are suitably aligned, whether any media sheets 34 of job stack 40 are misaligned, and whether job stack 40 is fully compiled (i.e., all media sheets 34 of a given media job reached accumulation region 42).

For instance, in one example, if during accumulation of job stack 40 media sensor 60 fails to detect a presence of media sheet 34, controller 69 may determine that a transport error has occurred along transport track 32 (e.g., a media jam) and deem the accumulation status of job stack 40 as being incomplete. In such case, controller 69 may halt the accumulation of job stack 40 by media registration system 30 and indicate to a user that intervention is required.

In another example, based on an indicated position of a media sheet 34 from media sensor 60, controller 69 may determine that translator 50 is unable to adjust registration end 38 by a registration distance, Xr, to align edges of media sheet 34 with the edges of the sheets of job stack 40 (e.g., the registration distance, Xr, exceeds a maximum registration distance, Xrmax, by which registration end 38 can be moved). In such case, controller 69 may allow media registration system 30 to continue accumulating job stack 40 for the given media job, but not forward the completed job stack 40 for secondary processing (e.g., stapling, hole-punching, binding) and alert a user that job stack 40 is misaligned.

In one example, controller 69 may be a component of the image forming apparatus from which media sheets 34 are received (e.g., a printer). In examples, media sensor 60 may be an optical sensor which detects a presence of an edge of a sheet of print media 34 by detecting whether a light beam has been interrupted (such as by emitting light onto a reflective surface and detecting the reflected light). In other examples, media sensor 60 may be a mechanical sensor, including a lever or switch (sometimes referred to as a flag) that detects a presence of an edge of a sheet of print media 34 through contact with lever by the sheet.

By using a media sensor (or sensors) to detect a position of each media sheet of a media job as each sheet is transported along the transport track, in accordance with examples of the present disclosure, media registration system 30 enables a determination as to whether a job stack is properly accumulated before forwarding the job stack for secondary operations, such as stapling, hole-punching, and binding, for example, thereby avoiding such secondary operations on misaligned or otherwise improperly accumulated job stacks.

Figure 2:
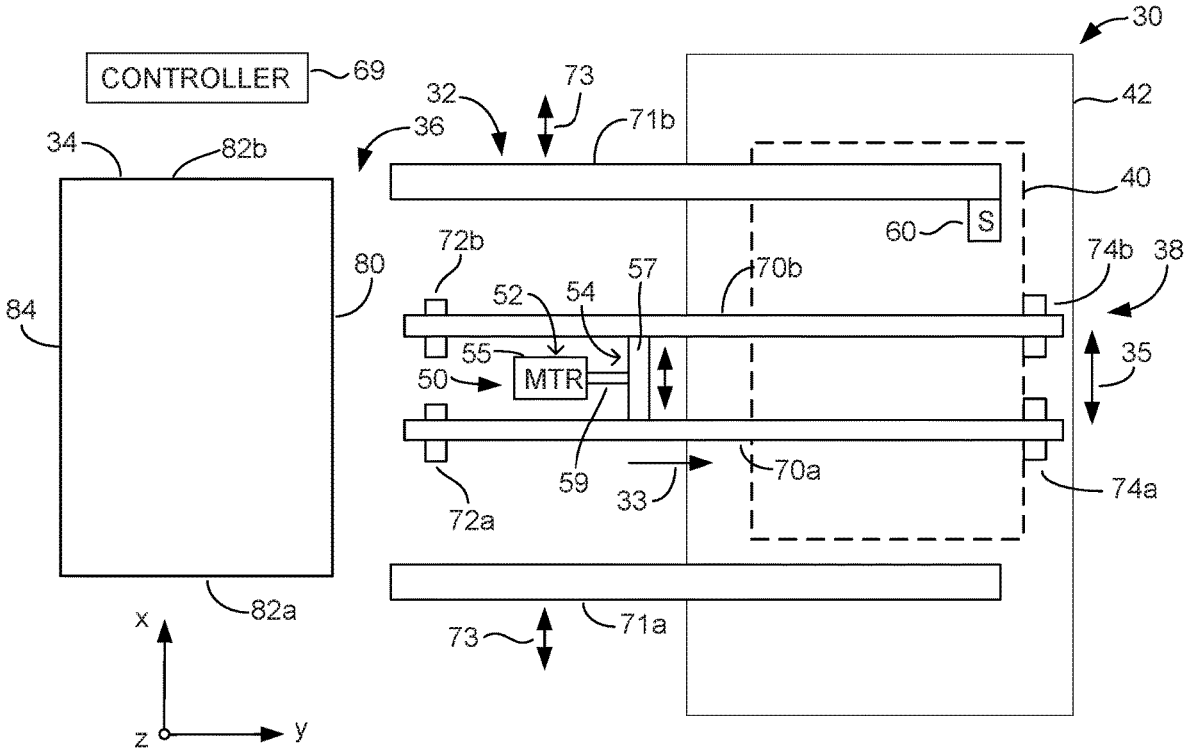
FIG. 2 is a block and schematic diagram generally illustrating a top view of a media registration system, according to one example.

FIG. 2 is a block and schematic diagram illustrating a top view of media registration system 30, according to one example, for accumulating a series of media sheets 34 of a media job received from an imaging device (such as a "print job" received from a printer) to form a job stack 40 (illustrated by dashed lines) in an accumulation region 42. According to the example of FIG. 2, transport track 32 includes a pair of parallel puller tracks 70*a* and 70*b*, and a pair of opposed media guides 71*a* and 71*b* positioned on opposite sides of puller tracks 70*a* and 70*b*. In one example, each puller track 70*a* and 70*b* includes a puller clamp, such as puller clamps 72*a* and 72*b*. In one example, media registration system 30 further includes a y-registration element 74 positioned at registration end 38, such as y-registration elements 74*a* and 74*b*.

In one example, driver 52 of translator 50 may be a motor 55 (e.g., a DC brushed motor) and translation element 54 may be implemented as a rack and pinion system, having a rack 57 operatively coupled to puller tracks 70*a* and 70*b*, and a pinion 59 driven by motor 55 to drive the rack 57 back and forth in the x-direction to move registration end 38 (either linearly or angularly) in the x-direction. It is noted that in other examples, translator 50 may be implemented using other types of actuating systems, including linear actuators, for example.

In examples, as described in greater detail below, puller clamps 72*a* and 72*b* receive and capture a leading edge 80 of media sheet 34, and are driven along puller tracks 70*a* and 70*b* (such as by a continuous belt) to pull media sheet 34 from intake end 36 to registration end 38. As media sheet is pulled along puller tracks 70*a* and 70*b*, media guides 71*a* and 71*b* respectively receive and support opposing first and second lateral edges 82*a* and 82*b* of media sheet 34 which extend between leading edge 80 and a trailing edge 84. Media guides 71*a* and 71*b* are each moveable in the x-direction toward and away from puller tracks 70*a* and 70*b*, as illustrated by directional arrows 73. In one example, media guides 71*a* and 71*b* are positioned in the x-direction relative to puller tracks 70*a* and 70*b*, such as by controller 69, based on dimensions of media sheet 34.

In one example, media sensor 60 is positioned along transport track 32 proximate to registration end 38. In one instance, media sensor 60 is mounted to one of the moveable media guides 71*a* and 71*b*, such as to media guide 71*b* as illustrated in FIG. 2. As will be described in greater detail below, for each media sheet 34 of a media job, media sensor 60 determines a position of the media sheet 34 as it is transported along transport track 32 (such as a position of leading edge 80 and/or one of the first and second lateral edges 82*a* and 82*b*, for example) to facilitate controller 69 to adjust a position of registration end 38 via translator 50 to align first and second lateral edges 82*a*, 82*b* o each media sheet 34 with the lateral edges the job stack (such as job stack 40 of FIG. 1), and to facilitate controller 69 to determine an accumulation status of job stack 40 (such as whether the job stack is misaligned, missing a sheet, or properly stacked, for example).

Figure 3A:
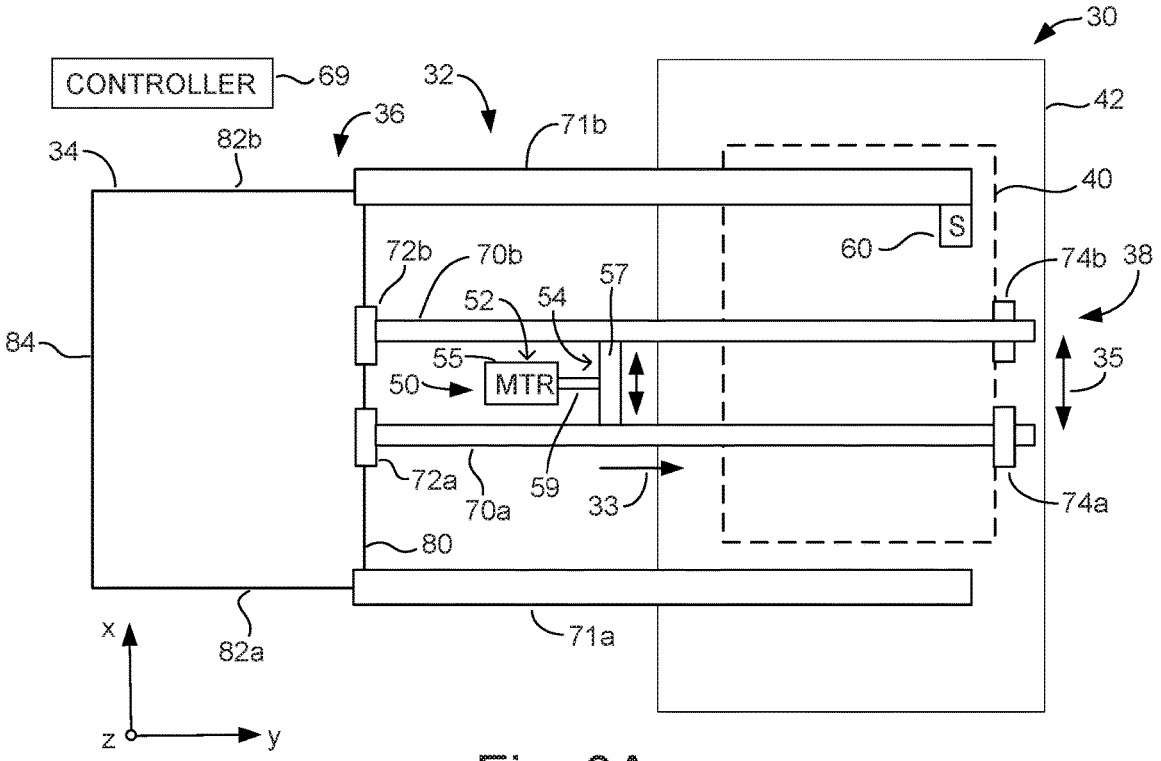
FIG. 3A is a block and schematic diagram generally illustrating a top view of a media registration system, according to one example.

FIGS. 3A-3G generally illustrate the operation of media registration 30 of FIG. 2 to accumulate media sheets of a media job, such as media sheet 34, to form a job stack 40, according to one example. With reference to FIG. 3A, in one example, puller clamps 72*a* and 72*b* are driven about a perimeter of puller tracks 70*a* and 70*b*, including along an upper side and a lower side of puller tracks 70*a* and 70*b*, such as by a continuous belt, for instance (not illustrated). In examples, puller clamps 72*a* and 72*b* alternate between an open position and a closed position as they travel along puller tracks 70*a* and 70*b*. In one example, puller clamps 72*a* and 72*b* are maintained in an open position when traveling along an upper side of puller tracks 70*a* and 70*b* from registration end 38 toward intake end 36. As puller clamps 72*a* and 72*b* move from the upper side to the lower side of puller tracks 70*a* and 70*b* at intake end 34, puller clamps 72*a* and 72*b* transition from the closed position to the open position to receive a leading edge 80 of media sheet 34, and then return to the closed position to retain the leading edge 80 of media sheet 34.

Figure 3B:
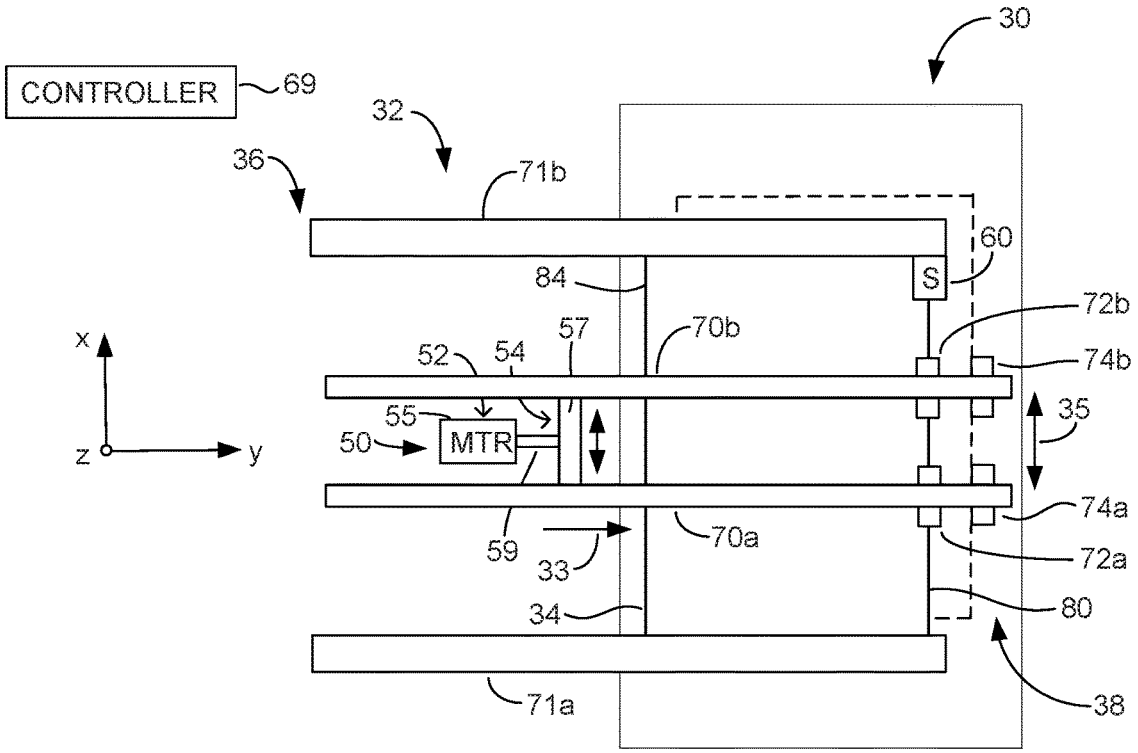
FIG. 3B is a block and schematic diagram generally illustrating a top view of a media registration system, according to one example.

With reference to FIG. 3B, as puller clamps 72*a* and 72*b* are driven along the lower side of puller tracks 70*a* and 70*b*, puller clamps 72*a* and 72*b* are maintained in a closed position and transport the captured media sheet 34 from intake end 36 toward registration end 38. According to one example, as illustrated by FIG. 3B, as media sheet 34 is pulled along transport track 32, upon detection of leading edge 80 by media sensor 60, controller 69 pauses the transport of media sheet 34. In one example, media sensor 60 is moveable between a first position, where leading edge 80 is detected (as illustrated by FIG. 3B), and a second position, where second lateral edge 82*b* is detected as media sensor 60 moves from the first position to the second position (as illustrated by FIG. 3D).

Figure 3C:
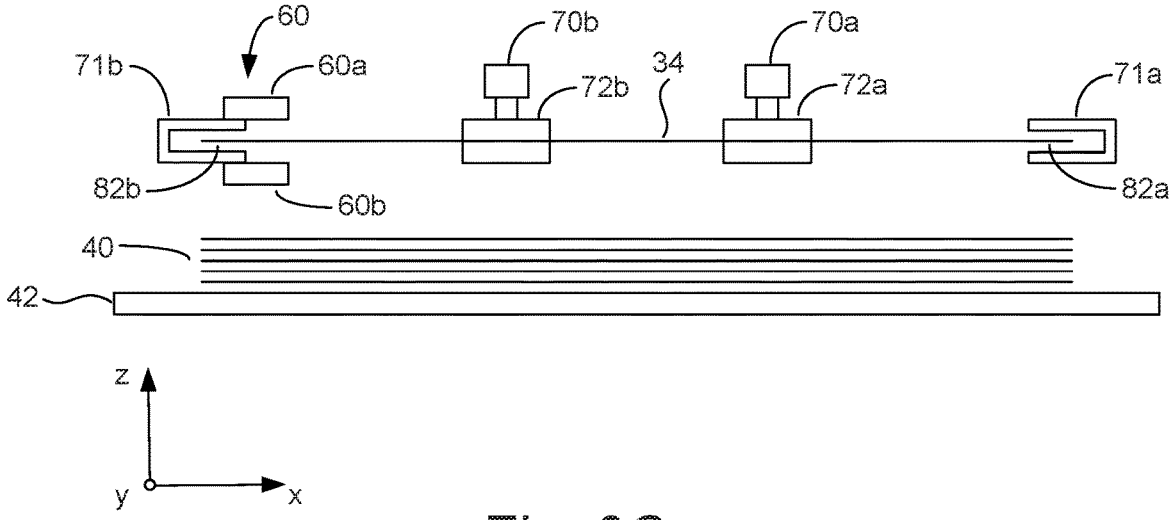
FIG. 3C is a block and schematic diagram illustrating a cross-sectional view of a media registration system, according to one example.

FIG. 3C is a cross-sectional view along the y-axis of media registration system 30 of FIG. 3B, where media sheet 34 is secured by puller clamps 72*a* and 72*b*, and first and second lateral edges 82*a* and 82*b* are respectively supported by media guides 71*a* and 71*b*. According to one example, media sensor 60 is an optical type sensor including a transmitter/receiver 60*a* and a reflector 60*b* which are mounted to media guide 71*b* so as to be on opposite sides of media sheet 34. In one example, media sensor 60 detects leading edge 80 of media sheet 34 when a light beam reflected back to transmitter/receiver 60*a* from reflector 60*b* is broken by media sheet 34. Job stack 40 is supported by accumulation region 42, which is sometimes referred to as a mezzanine.

Figure 3D:
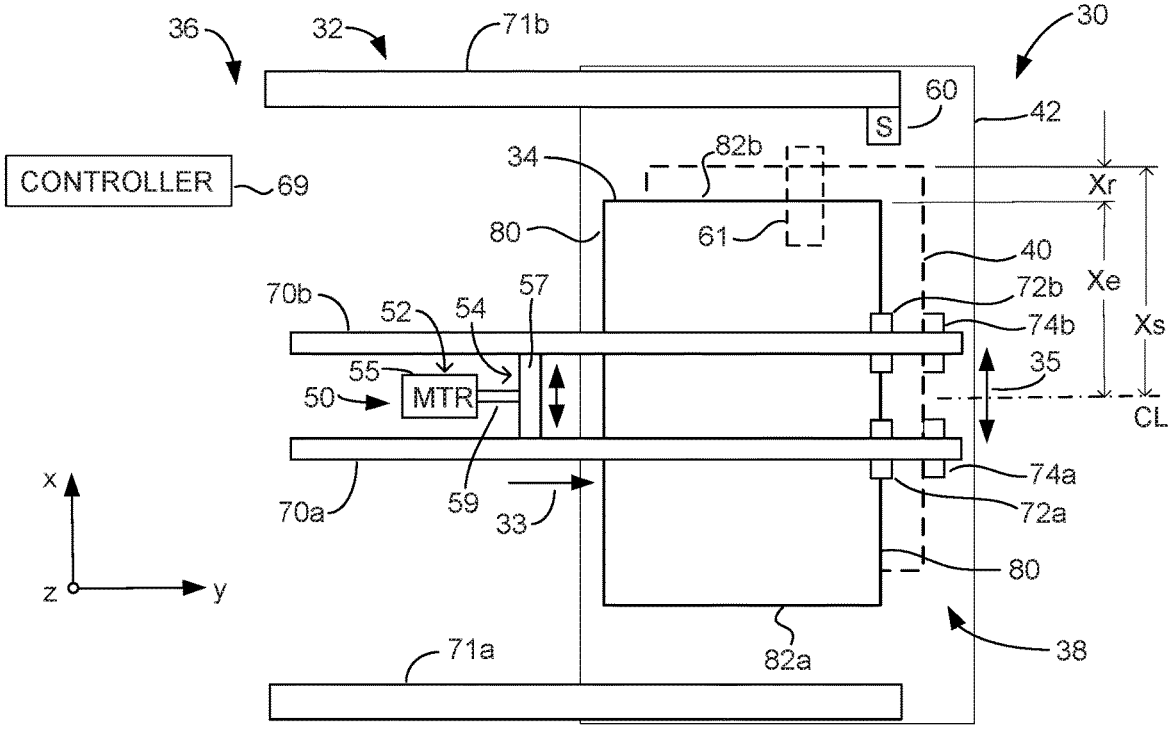
FIG. 3D is a block and schematic diagram generally illustrating a top view of a media registration system, according to one example.

Referring to FIG. 3D, in one example, with transport of media sheet 34 paused, controller 69 moves media guides 71*a* and 71*b* away from puller tracks 70*a* and 70*b* to release first and second lateral edges 82*a* and 82*b* of media sheet 34. As media guide 71*b* moves away from puller track 70*b*, media sensor 60 measures an edge distance, Xe, of second lateral edge 82*b* of media sheet 34 from a reference, such as a centerline (CL) of transport track 32.

According to one example, controller 69 determines a registration distance, Xr, by which to move registration end 38 in the x-direction to align second lateral edge 82*b* of media sheet 34 with job stack 40 by determining the difference between the measured distance, Xe, and a stack distance, Xs, from the centerline, CL, to an edge of job stack 40. In one example, as described below, a registration distance, Xr, greater than a maximum registration distance, Xrmax, by which translator 50 can adjust registration end 38 is indicative of a misalignment between media sheet 34 and job stack 40. In such case, according to one example, translator 50 adjusts the position of registration end 38 by Xrmax and media registration system 30 completes the process of accumulating media sheet 34 on job stack 40, as described below.

Figure 3E:
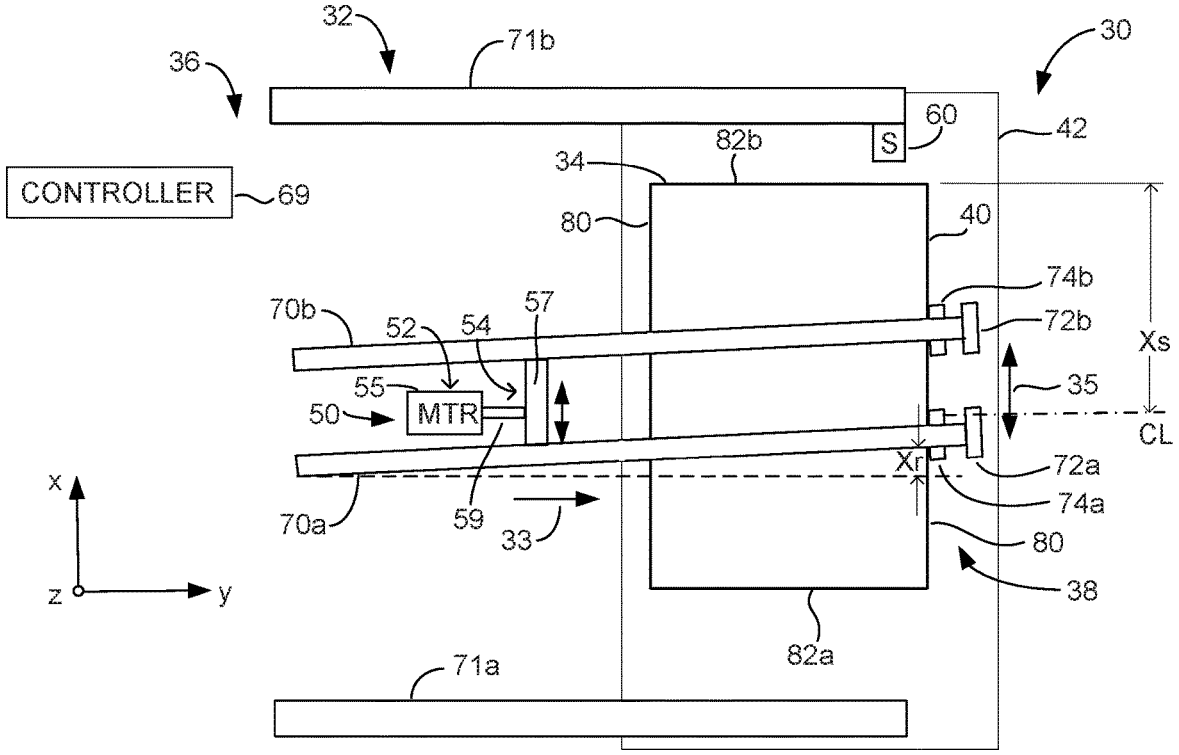
FIG. 3E is a block and schematic diagram generally illustrating a top view of a media registration system, according to one example.

With reference to FIG. 3E, according to one example, after determining the registration distance, Xr, controller 69 rotates puller tracks 70*a* and 70*b*, via control of translator 50, such that second lateral edge 82*b* will be at the stack distance, Xs, from the centerline, CL, upon reaching y-registration elements 74*a* and 74*b* and, thus, be aligned with job stack 40. In one example, upon adjusting the position of registration end 38 of transport track 32, controller 69 directs transport track 32 to resume transport of media sheet 34 toward registration end 38.

In one example, puller clamps 72*a* and 72*b* each include a nip to capture and secure media sheet 34. In one example, each nip is formed by a pair of biased rollers (not illustrated). As puller clamps 72*a* and 72*b* pull media sheet 34 along the lower side of puller tracks 70*a* and 70*b*, leading edge 80 of media sheet 34 contacts and is registered in transport direction 33 by y-registration elements 74*a* and 74*b*. Upon leading edge 80 of media sheet 34 contacting y-registration elements 74*a* and 74*b*, media sheet 34 in prevented from further movement in transport direction 33. As a result, as puller clamps 72*a* and 72*b* continue to move along puller tracks 70*a* and 70*b* in transport direction 33, media sheet 34 is "pushed" from the nips of puller clamps 72*a* and 72*b* by y-registration elements 74*a* and 74*b*.

In one example, upon release from puller clamps 72*a* and 72*b*, as media sheet 34 begins to fall by gravity toward job stack 40 (in accumulation region 42 disposed below puller tracks 70*a* and 70*b*), a leading edge clamp 88 is driven downward to push media sheet onto job stack 40 (see FIG. 3G below). In one example, after the release of media sheet 34 from puller clamps 72*a* and 72*b*, puller clamps 72*a* and 72*b* transition from the lower side to the upper side of puller tracks 70*a* and 70*b* at registration end 38 and return to intake end 36 to receive another media sheet.

Figure 3F:
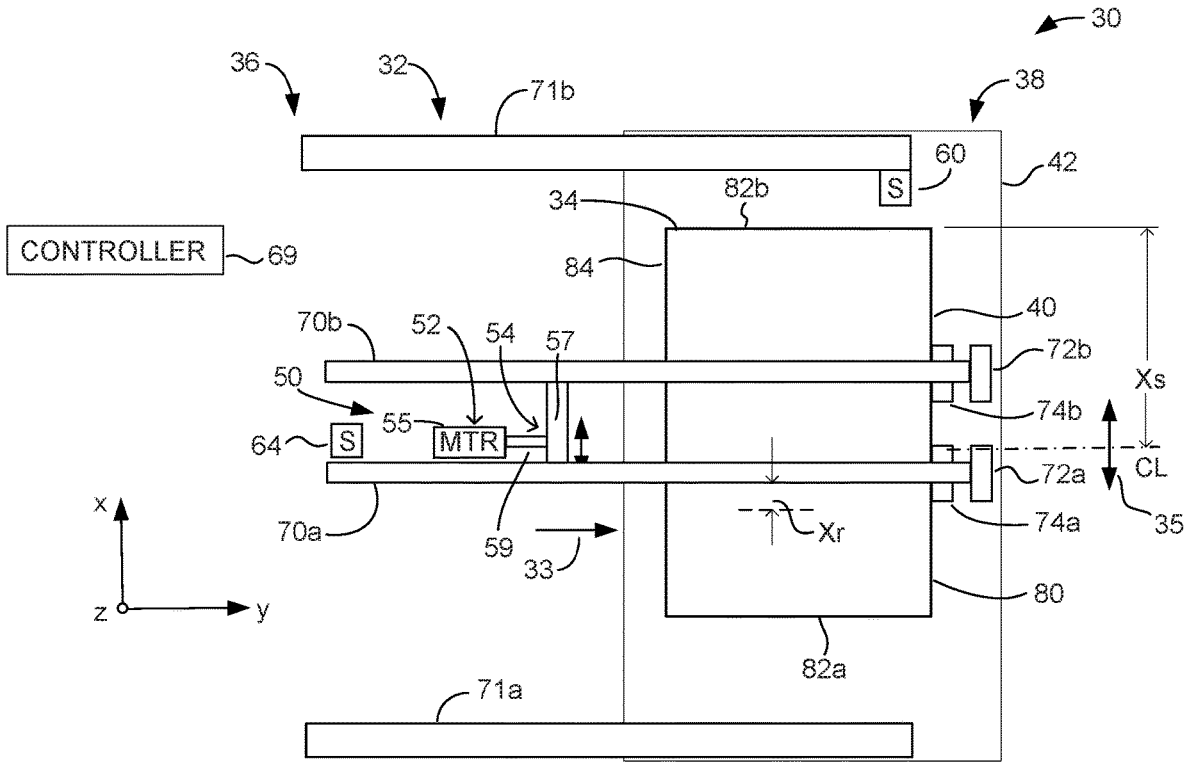
FIG. 3F is a block and schematic diagram generally illustrating a top view of a media registration system, according to one example.

With reference to FIG. 3F, in one case, in lieu of rotating puller tracks 70*a* and 70*b* to adjust an x-direction position of registration end 38 (as illustrated by FIG. 3E), translator 50 linearly translates puller tracks 70*a* and 70*b* in the x-direction by the registration distance, Xr, so that second lateral edge 82*b* of media sheet 34 is at the stack distance, Xs, from centerline, CL, and is aligned with job stack 40.

Figure 3G:
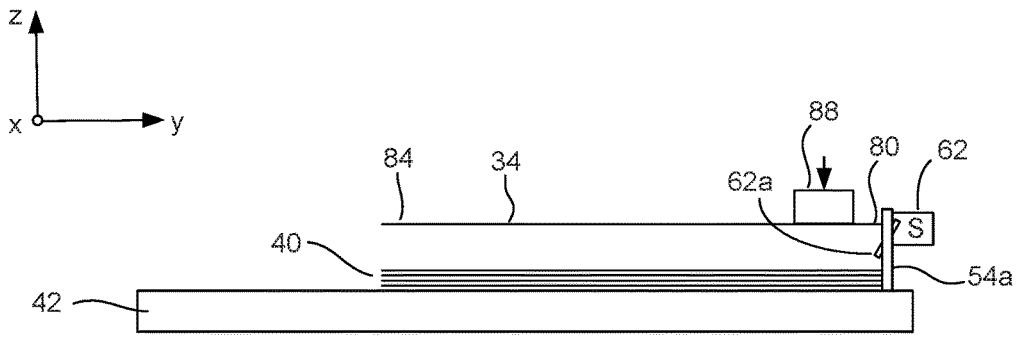
FIG. 3G is a block and schematic diagram generally illustrating a side cross-sectional view of a media registration system, according to one example.

FIG. 3G is a cross-sectional view in the x-direction of media transport system 30 of FIGS. 3E and 3F, and illustrates leading edge clamp 88 pushing leading edge 80 of the now-registered media sheet 34 downward onto job stack 40 are being released from puller clamps 72*a* and 72*b*. If left to fall by the force of gravity without the use of leading edge clamp 88, media sheet 34 may fall in an uncontrolled fashion due to a curvature of media sheet 34 and air trapped there under and potentially lead to misalignment with job stack 40.

In one example, in addition to media sensor 60, media registration system 30 includes a media sensor 62 disposed at registration end 38, such as between y-registration elements 74*a* and 74*b*, for instance. In one case, media sensor 62 is a mechanical type sensor including a lever or flag 62*a* which is "tripped" upon contact by leading edge 80 to media sheet 34 as it drops onto job stack 40. Upon tripping lever 62*a*, media sensor 62 provides indication to controller 69 that media sheet 34 has been accumulated on job stack 40.

Although illustrated as being mounted to moveable media guide 71*b*, in other examples, media sensor 60 may be mounted to a moveable element, such as a carriage (not illustrated), which is separate from media guide 71*b*. In other examples, in lieu of a point type sensor which is moved in the x-direction to detect second lateral edge 82*b* of media sheet 34 after first detecting leading edge 80, a curtain type media sensor 61 may be deployed, such as illustrated by the dashed box at 61 in FIG. 3D, which is stationary but detect edges of media sheet 34 over a range of distances in the x-direction from centerline, CL (by employing an array of point sensors, for example) In one example, with reference to FIG. 3F, media registration system 30 includes a media sensor 64 positioned along transport track 32 proximate to intake end 36 to detect leading edge 80 and trailing edge 84 of media sheet 34 as media sheet 34 is transported along transport track 32.

FIGS. 4A-4D illustrate media registration system 30, according to another example of the present disclosure, where, in lieu of puller tracks, transport track 32 includes a plurality of pairs of rollers, such as roller pairs 90 and 92. In one example, each roller pair 90 and 92 includes a drive roller and a pinch roller, such as illustrated by drive rollers 90*a* and 92*a* (see FIG. 4D for corresponding pinch rollers 90*b* and 92*b*). In one example, roller pair 90 is referred to as an entrance roller pair 90, and roller pair 92 is referred to as an exit roller pair 92. In one example, a media sensor 66 is disposed along transport track 32 between entrance roller pair 90 and exit roller pair 92, and is positioned to detect alignment of second lateral edge 82*b* of media sheet 34 with an upper edge 44 of job stack 40. According to one example, driver 52 of translator 50 is in mechanical communication with exit roller pair 92 via translation element 54 and, as will be illustrated in greater detail below, translates exit roller pair 92 in the x-direction so as to align second lateral edge 82*b* of media sheet 34 with a location of the upper edge 44 of job stack 40.

Figure 4A:
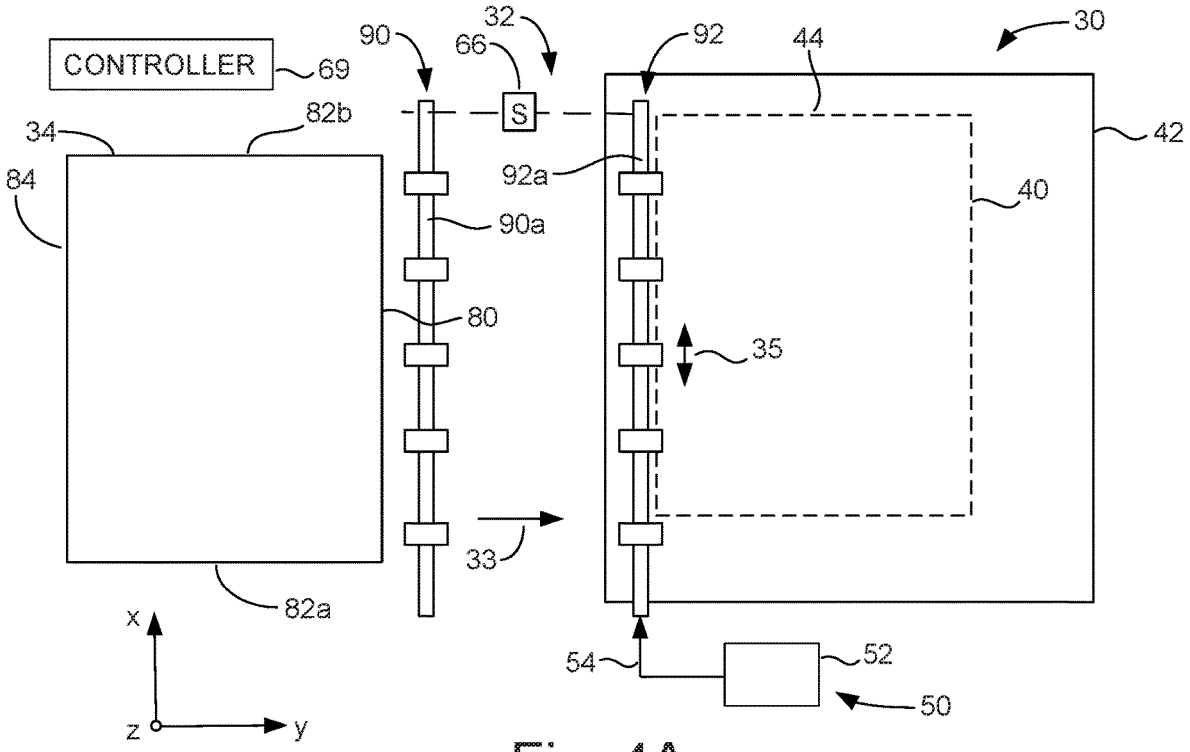
FIG. 4A is a block and schematic diagram generally illustrating a top view of a media registration system, according to one example.
Figure 4B:
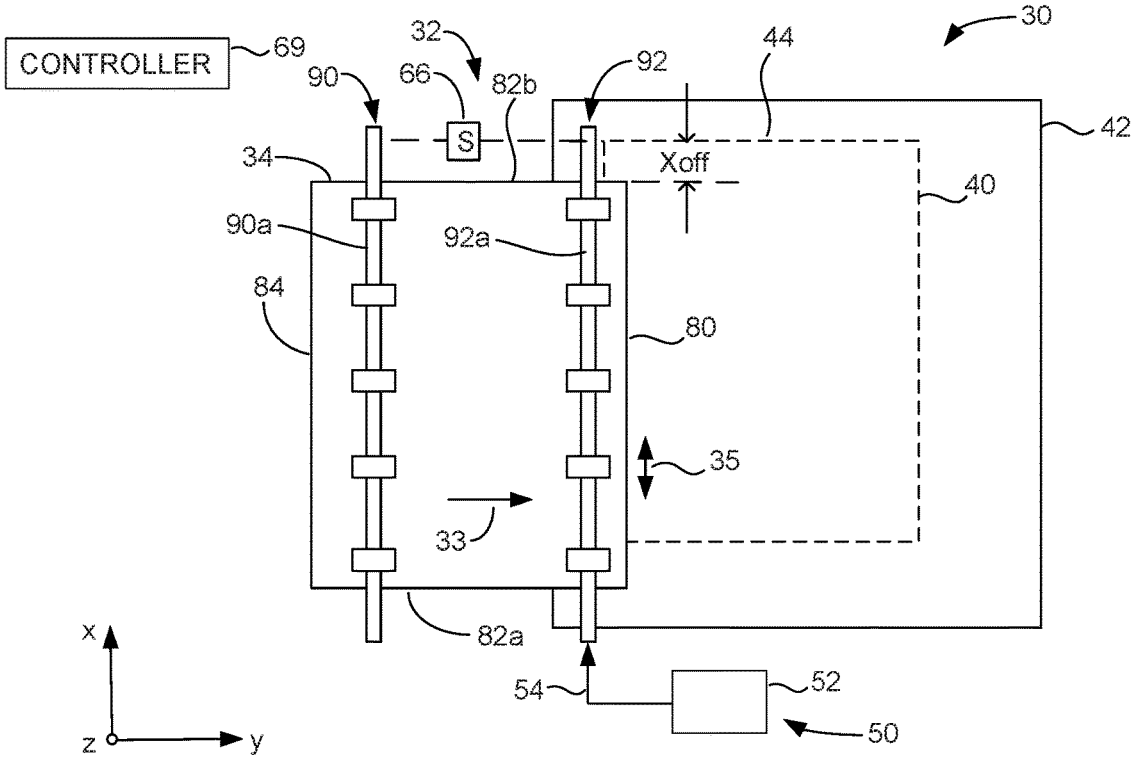
FIG. 4B is a block and schematic diagram generally illustrating a top view of a media registration system, according to one example.

Referring to FIG. 4B, entrance and exit roller pairs 90 and 92 receive media sheet 34 and convey media sheet 34 toward accumulation region 42 with lateral edge 82 of media sheet 34 at an offset distance, Xoff, from the location of the upper edge 44 of job stack 40.

Figure 4C:
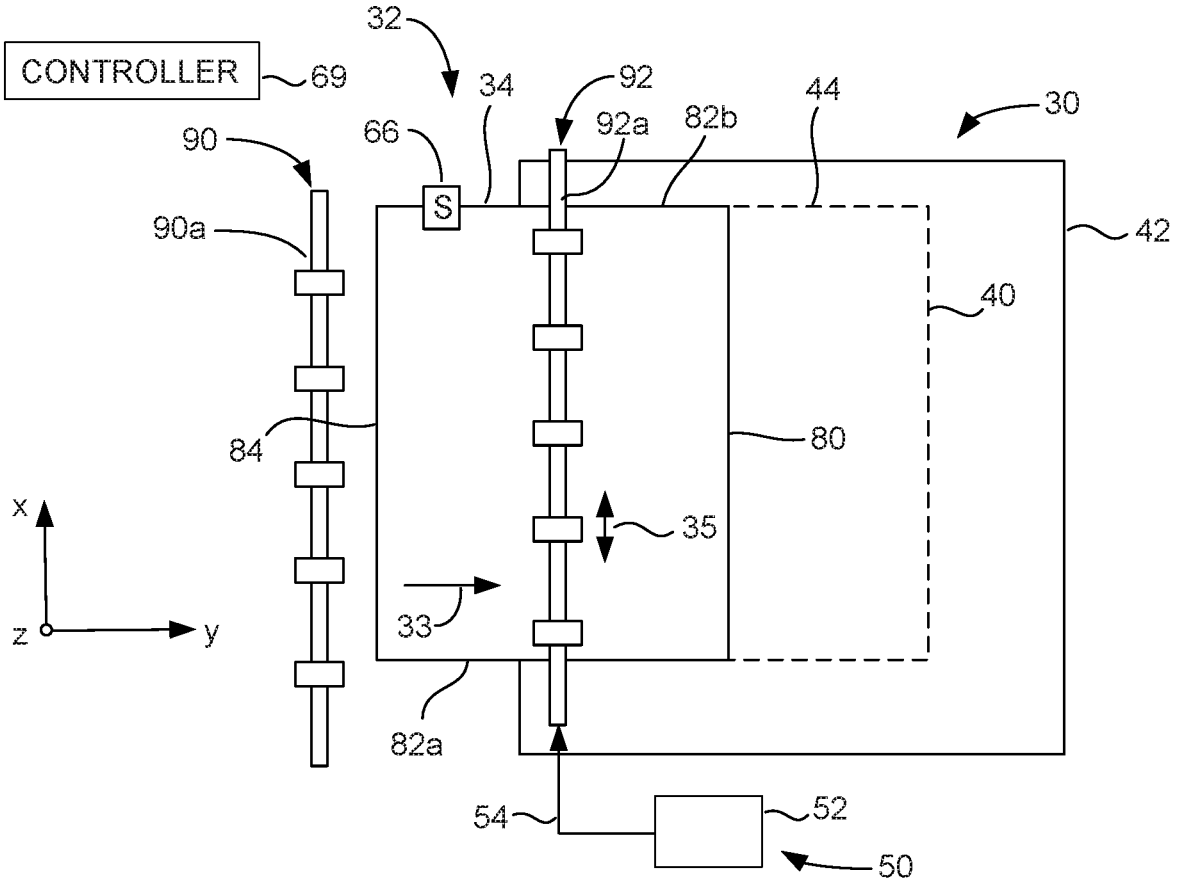
FIG. 4C is a block and schematic diagram generally illustrating a top view of a media registration system, according to one example.

With reference to FIG. 4C, in one example, upon trailing edge 84 of media sheet 34 passing entrance roller pair 90, such that media sheet 34 is controlled by exit roller pair 92, controller 69 pauses the conveyance of media sheet 34 in transport direction 33. In one example, with the conveyance of media sheet 34 paused, translator 50 translates exit roller pair 92 in the x-direction until second lateral edge 82*b* of media sheet 34 is detected by media sensor 66, such that second lateral edge 82*b* is aligned in the x-direction with the location of the upper edge 44 of job stack 40. Upon second lateral edge 82*b* being aligned with the location of upper edge 44 of job stack 40, controller 69 resumes conveyance of media sheet 34 by exit roller pair 92 toward accumulation region 42. In other examples, due to the positioning of media sensor 66, conveyance of media sheet 34 is not paused during lateral alignment of media sheet 34.

Figure 4D:
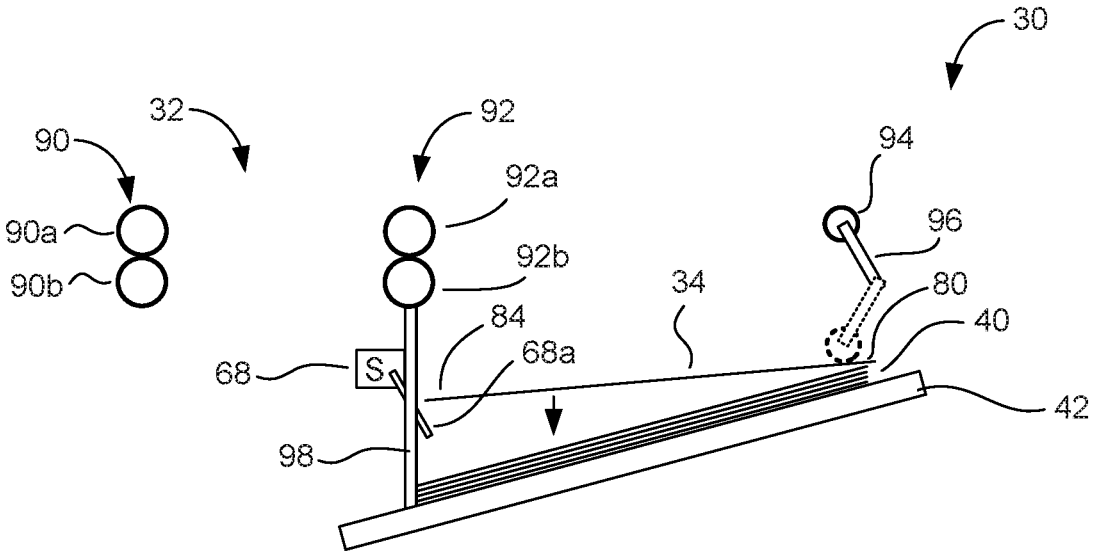
FIG. 4D is a block and schematic diagram generally illustrating a side cross-sectional view of a media registration system, according to one example.

With reference to FIG. 4D, which is a cross-sectional side view of media conveyance system 30 of FIG. 4C, when trailing edge 84 of media sheet 34 passes through exit roller pair 92, media sheet 34 is deposited onto job stack 40 in accumulation region 42 (e.g., a mezzanine or tray). In one example, a reversing roller 94 mounted on a rotating arm 96 descends onto media sheet 34 to control the placement of media sheet 34 onto job stack 40 and drives trailing edge 84 against a y-registration wall 98 to align job stack 40 in the y-direction.

In one example, in addition to media sensor 66, media registration system 30 includes a media sensor 68 disposed at y-registration wall 98. In one example, media sensor 68 includes a lever or flag 68*a* extending past registration wall 98. As media sheet 34 falls onto job stack 40, flag 68*a* is tripped to provide indication to controller 69 that media sheet 34 has been deposited onto job stack 40. Similarly, a failure of lever 68*a* to be tripped after a media sheet 34 has passed media sensor 66 along transport path 32 indicates a failure of media sheet 34 to reach job stack 40.

In view of the above, by monitoring the position of each media sheet 34 of a media job with media sensors (e.g., media sensors 60, 62, 64, 66, and 68) disposed along the transport path, media registration system 30, in accordance with examples the present disclosure, enables a determination of an accumulation status of job stack 40, such as by controller 69, for instance.

With reference to FIGS. 3A-3F, in one example, controller 69 may determine that a transport error of media sheet 34 has occurred between intake end 36 and accumulation region 42 if media sensor 60 fails to detect leading edge 80, if media sensor 60 fails to detect leading edge 80 within an expected time period after trailing edge 84 has been detected by media sensor 64 (e.g., based on a known transport speed), and if media sensor 62 at accumulation region 42 fails to detect media sheet 34 being deposited on job stack 40. In such cases, controller 69 may determine that a transport error of media sheet 34 has occurred, stop the accumulation process, deem the accumulation status of the job stack 40 as being incomplete, and provide an error indication to a user.

In another case, with reference to FIGS. 3A-3G, if after determining the edge distance, Xe, of media sheet 34 via media sensor 60, controller 69 determines that a registration distance, Xr, by which registration end 38 of transport track 32 is to be translated in the x-direction in order to align media sheet 34 with job stack 40 exceeds a maximum registration distance, Xrmax, by which registration end 38 can be adjusted, controller 69 may continue with the accumulation of job stack 40 for the given media job, but deem the accumulation status of job stack 40 as being misaligned. In such case, although controller 69 may allow an accumulation of job stack 40 to be completed for the given media job, controller 69 may prevent the job stack 40 from being forwarded for secondary processing and may provide notification to a user that job stack 40 is misaligned.

In another case, with reference to FIGS. 3A-3F, controller 69 may deem an accumulation status of job stack 40 as being satisfactory, such as when registration distance, Xr, as determined for each sheet of imaging media 34 of a media job is less than a maximum registration distance, and when media sensor 62 (when employed) has indicated that each media sheet 34 has been placed on job stack 40. In such case, controller 69 will forward the accumulated job stack 40 for any secondary processes (e.g., stapling, hole-punching, binding) which are to be performed.

With reference to FIGS. 4A-4D, in one case, after translating exit roller pair 92 by a maximum translation distance, Xrmax, in the x-direction, if media sensor 66 fails to detect second lateral edge 82*b* of media sheet 34, and if media sensor 68 subsequently fails to detect such media sheet 34 at accumulation region 42, controller 69 may determine that a transport error of media sheet 34 has occurred. In another case, if media sensor 66 detects second lateral edge 82*b* of media sheet 34, but media sensor 68 subsequently fails to detect such media sheet 34 at accumulation region 42, controller 69 may also determine that a transport error has occurred. In such instances, controller 69 may stop the accumulation process of the media job, deem the accumulation status of the job stack 40 as being incomplete, and provide an error indication to a user.

In another case, after translating exit roller pair 92 by a maximum translation distance, Xrmax, in the x-direction, if media sensor 66 fails to detect second lateral edge 82*b* of media sheet 34, but media sensor 68 subsequently detects such media sheet 34 at accumulation region 42, controller 69 may continue with the accumulation of job stack 40 for the given media job, but deem the accumulation status of job stack 40 as being misaligned. In such case, although controller 69 may allow an accumulation of job stack 40 to be completed for the given print job, controller 69 may prevent the job stack 40 from being forwarded for secondary processing and may provide notification to a user that job stack 40 is misaligned.

Figure 5:
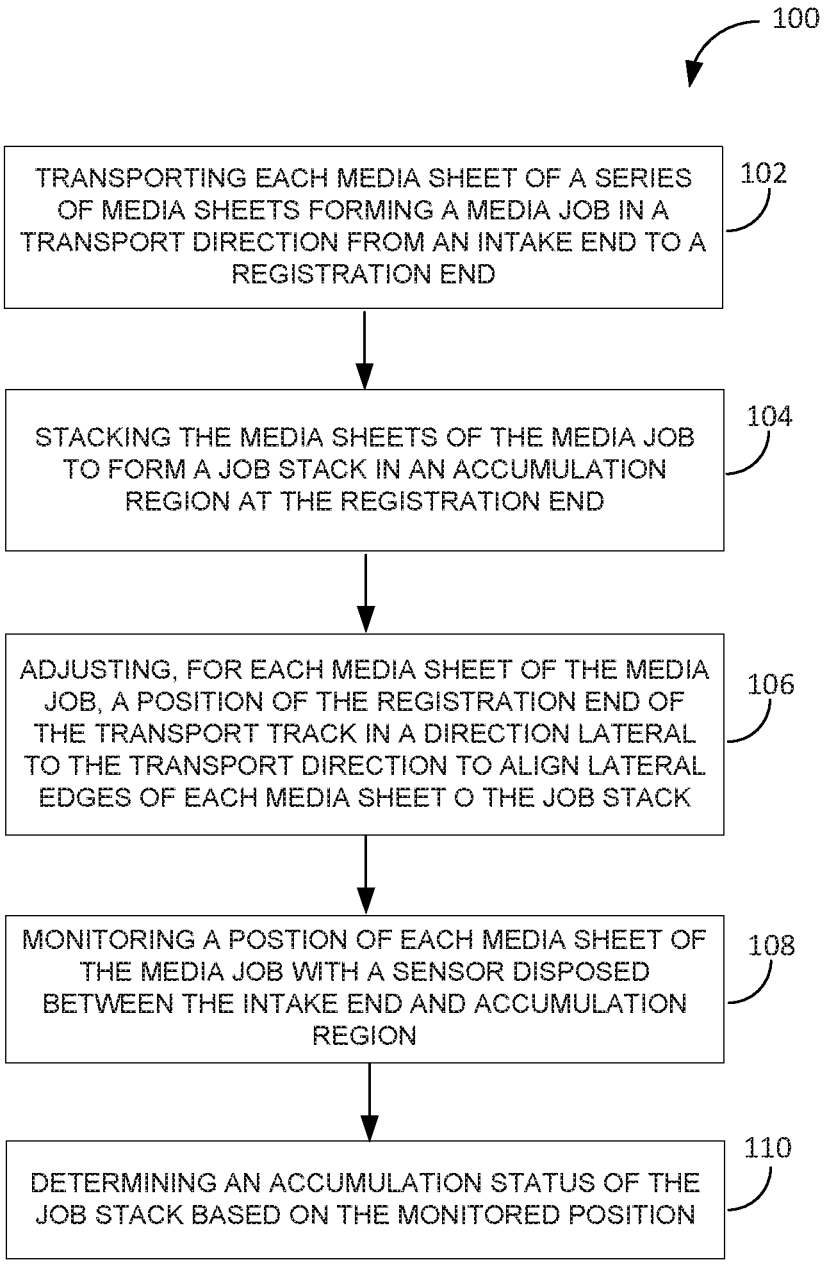
FIG. 5 is a flow diagram illustrating a method of registering media, according to one example.

FIG. 5 is a flow diagram generally illustrating a method 100 of accumulating imaging media sheets of a media job to form a job stack using a media registration system including a transport track having a registration end that can be translated in a direction lateral to a transport direction to align media sheets of the job stack in the lateral direction, such as media registration system 30 of FIG. 3A having a transport track 32 including puller tracks 70*a* and 70*b* that can be rotated to adjust registration end 38 in direction 35 that is lateral to a transport direction 33.

At 102, method 100 includes transporting each media sheet of a series of media sheets forming a media job in a transport direction along a transport track from an intake end to a registration end, such as illustrated by FIGS. 3A to 3F, where media sheets 34 are transported in transport direction 33 by puller clamps 72*a* and 72*b* along puller tracks 70*a* and 70*b* from intake end 36 to registration end 38, with first and second lateral edges 82*a* and 82*b* being supported by media guides 71*a* and 71*b*.

At 104, method 100 includes stacking each media sheet of the media job to form a job stack in an accumulation region at the registration end, such as illustrated by FIGS. 3F and 3G, where media sheets 34 are pushed from puller clamps 72*a* and 72*b* by leading edges 80 of media sheets 34 contacting y-registration elements 74*a* and 74*b*, with puller clamps 72*a* and 72*b* continuing to move in transport direction 33. The released media sheets 34 are deposited with the assistance of leading edge clamp 88 onto job stack 40 in accumulation region 42 disposed below registration end 38 of puller track 32.

At 106, as each media sheet of the media job is transported along the transport track, method 100 includes adjusting a position of the registration end of the transport track in a direction lateral to the transport direction to align lateral edges of each media sheet of the job stack, such as illustrated by FIG. 3E, where registration end 38 of transport track 32 is moved by translator 50 by a registration distance, Xr, in lateral direction 35 to align first and second lateral edges 82*a* and 82*b* of media sheets 34 with job stack 40.

At 108 and 110, method 100 includes determining an accumulation status of the job stack by monitoring a position of each media sheet of the media job with a sensor disposed between the intake end and the accumulation region, such as media sensor 60 of FIG. 3D monitoring an edge position, Xe, of second lateral edge 82*b* of media sheet 34 relative to a reference, such as a centerline, CL, of transport track 32, where such position facilitates controller 69 to determine an accumulation status of job stack 40 (e.g., whether a media sheet is missing from the job stack, whether media sheets are misaligned within the job stack, and whether the job stack is properly aligned, or instance).

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A media registration system comprising:

an accumulation region;

a transport track to:

receive and transport each media sheet of a series of media sheets forming a media job in a transport direction from an intake end to a registration end proximate to the accumulation region; and stack the media sheets of the media job in the accumulation region to form a job stack;

a translator to adjust a position of the registration end of the transport track in a direction lateral to the transport direction for each media sheet to align edges of each media sheet of the job stack in the lateral direction; and a media sensor to indicate a position of each media sheet between the intake end and the accumulation region to facilitate a controller to determine an accumulation status of the job stack, each media sheet including a first lateral edge and an opposing second lateral edge parallel to the transport direction, the media sensor including a first media sensor disposed between the intake end and registration end to determine a position the second lateral edge.

2. The media registration system of claim 1, the first media sensor to determine an edge distance in the lateral direction from the second lateral edge to a reference, a difference between the edge distance and a stack distance from a corresponding edge of the job stack and the reference being greater than a maximum registration distance by which the translator can adjust the position of the registration end in the lateral direction being indicative of an accumulation status representing a misalignment between a media sheet and the job stack.

3. The media registration system of claim 2, a failure of the first media sensor to detect a media sheet being indicative of an accumulation status representing an incomplete job stack due to a transport error of the media sheet.

4. The media registration system of claim 2, the first sensor being a curtain type media sensor to detect the media sheet, including detecting the second lateral edge over a range of distances in the lateral direction from the reference.

5. The media registration system of claim 2, first media sensor comprising a point type sensor moveable in the lateral direction from a first position to a second position, the first media sensor to move from the first position to the second position upon detection of a leading edge of the media sheet when at the first position, and to detect the distance of the second lateral edge from the reference when moving from the first position to the second position.

6. The media registration system of claim 5, the first media sensor mounted to a media guide supporting the second lateral edge of the media sheet, the media guide moveable in the lateral direction to release the media sheet.

7. The media registration system of claim 2, including a second media sensor disposed between the transport track and the job stack to detect placement of a media sheet onto the job stack, a failure of the second media sensor to detect a media sheet being indicative of an accumulation status representing an incomplete job stack due to a transport error.

8. The media registration system of claim 1, the first media sensor aligned with an edge of the job stack in the lateral direction, the translator to translate the registration end of the transport track in the lateral direction by an offset distance until the first media sensor detects the second lateral edge of the media sheet.

9. The media registration system of claim 8, including a second media sensor disposed between the transport track and the job stack to detect placement of a media sheet onto the job stack.

10. The media registration system of claim 9, failure of the first media sensor to detect the second lateral edge of a media sheet after translation of the registration end by a maximum translation distance together with subsequent detection of the media sheet by the second media sensor being indicative of an accumulation status representing a misaligned job stack.

11. The media registration system of claim 9, a failure of the second media sensor to detect a media sheet being indicative of an accumulation status representing an incomplete job stack due to a transport error.

12. A media registration system comprising:
an accumulation region;
a transport track to:
receive and transport each media sheet of a series of media sheets forming a media job in a transport direction from an intake region to a registration end proximate to the accumulation region, each media sheet having a first lateral edge and a second lateral edge parallel to the transport direction; and
stack the media sheets of the media job in the accumulation region to form a job stack;
a translator to adjust a position of the registration end of the transport track in a direction lateral to the transport direction for each media sheet to align the first and second lateral edges of each media sheet of the job stack;
a media sensor disposed between the intake end and the registration end to determine an edge distance in the lateral direction from the second lateral edge to a reference; and
a controller to:
determine a difference between the edge distance and a stack distance in the lateral direction from an edge of the job stack to the reference based on the edge distance provided by the media sensor and
deem an accumulation status of the job stack as being misaligned if the difference is greater than a maximum distance by which the translator can adjust the position of the registration end in the lateral direction, and otherwise to provide to the translator the difference between the edge distance and the stack distance by which the translator is to adjust the position of the registration end of the transport track.

13. The media registration system of claim 12, the controller deem the accumulation status of the job stack as incomplete upon failure of the media sensor to detect a media sheet.

14. The media registration system of claim 12, the media sensor comprising a point type sensor moveable in the lateral direction from a first position to a second position, the media sensor to move from the first position to the second position upon detection of a leading edge of the media sheet when at the first position, and to detect the edge distance from the second lateral edge to the reference when moving from the first position to the second position.

15. A media registration system comprising:
an accumulation region;
a transport track to:
receive and transport each media sheet of a series of media sheets forming a media job in a transport direction from an intake end to a registration end proximate to the accumulation region; and
stack the media sheets of the media job in the accumulation region to form a job stack;
a translator to adjust a position of the registration end of the transport track in a direction lateral to the transport direction for each media sheet to align edges of each media sheet of the job stack in the lateral direction;
a sensor to indicate a position of each media sheet between the intake end and the accumulation region;
a controller, based on the indicated position of the media sheet from the sensor to:
provide to the translator a distance by which the translator is to adjust the position of the registration end of the transport track; and
provide an accumulation status of the job stack; and
an accumulation region media sensor disposed between the transport track and the job stack to detect placement of a media sheet onto the job stack, the controller to deem the accumulation status as being incomplete upon failure of the accumulation region media sensor to detect a media sheet.

16. A method of accumulating imaging media sheets including:
transporting each media sheet of a series of media sheets forming a media job in a transport direction along a transport track from an intake end to a registration end;
stacking the media sheets of the media job to form a job stack in an accumulation region at the registration end;
adjusting, for each media sheet of the media job, a position of the registration end of the transport track in a direction lateral to the transport direction to align lateral edges of each media sheet of the job stack;
monitoring a position of each media sheet of the media job with a media sensor disposed between the intake end and the accumulation region, each media sheet having a first lateral edge and a second lateral edge parallel to the transport direction, where monitoring the position of each media sheet includes determining with the media sensor an edge distance in the lateral direction from the second lateral edge to a reference; and
determining an accumulation status of the job stack based on the monitored position.

17. The method of claim 16, where determining an accumulation status includes:
determining a difference between the edge distance and a stack distance in the lateral direction from an edge of the job stack to the reference;
deeming the accumulation status of the job stack as being misaligned if the difference is greater than a maximum distance by which the translator can adjust the position of the registration end in the lateral direction; and
deeming the accumulation status of the job stack as being incomplete if the media sensor fails to detect a media sheet.

* * * * *